US010444680B2

(12) United States Patent
Kato

(10) Patent No.: US 10,444,680 B2
(45) Date of Patent: Oct. 15, 2019

(54) IMAGE FORMING APPARATUS AND CONTROL METHOD THEREOF

(71) Applicant: BROTHER KOGYO KABUSHIKI KAISHA, Aichi-ken (JP)

(72) Inventor: Sadaharu Kato, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/262,883

(22) Filed: Jan. 30, 2019

(65) Prior Publication Data

US 2019/0235423 A1 Aug. 1, 2019

(30) Foreign Application Priority Data

Jan. 31, 2018 (JP) ..... 2018-014892

(51) Int. Cl.
*G03G 15/20* (2006.01)

(52) U.S. Cl.
CPC ..... *G03G 15/2039* (2013.01); *G03G 15/2042* (2013.01)

(58) Field of Classification Search
CPC ..... G03G 15/2039; G03G 15/2042; G03G 15/2082; G03G 15/2021; G03G 15/2007; G03G 15/205; G03G 15/2078; G03G 21/20
See application file for complete search history.

(56) References Cited

U.S. PATENT DOCUMENTS

| | | | | |
|---|---|---|---|---|
| 5,512,993 | A | 4/1996 | Endo et al. | |
| 2009/0028590 | A1* | 1/2009 | Nanataki | G03G 15/2042 399/44 |
| 2015/0253705 | A1* | 9/2015 | Shimura | G03G 15/2039 399/33 |

FOREIGN PATENT DOCUMENTS

| | | | |
|---|---|---|---|
| JP | 6-11999 | A | 1/1994 |
| JP | 9-319250 | A | 12/1997 |
| JP | 2011-59490 | A | 3/2011 |
| JP | 2011-221106 | A | 11/2011 |
| JP | 2014-81424 | A | 5/2014 |

* cited by examiner

*Primary Examiner* — Hoang X Ngo
(74) *Attorney, Agent, or Firm* — Kenealy Vaidya LLP

(57) ABSTRACT

An image forming apparatus has a process unit, a heating member that heats a sheet, a first heat source, a second heat source, a first temperature detector that detects a temperature of a first region including a central portion of the heating member in a width direction, a second temperature detector that detects a temperature of a second region including an end portion of the heating member, and a controller. The controller controls a supply of a current to the first heat source such that a temperature of the first region reaches a first target temperature, increases the first target temperature with a first gradient toward a first fixing temperature, controls a supply of a current to the second heat source such that a temperature of the second region reaches a second target temperature, and increases the second target temperature with a second gradient toward a second fixing temperature.

20 Claims, 9 Drawing Sheets

IMAGE FORMING APPARATUS AND CONTROL METHOD THEREOF

CROSS-REFERENCE TO RELATED APPLICATION

This application claims priority from Japanese Patent Application No. 2018-014892 filed on Jan. 31, 2018, the entire subject-matter of which is incorporated herein by reference.

TECHNICAL FIELD

The present disclosure relates to an image forming apparatus and a control method of the image forming apparatus.

BACKGROUND

In the related art, an image forming apparatus capable of executing temperature control on a fixing device including a plurality of heat sources has been known which is configured to control each heat source on the basis of a detection result of a corresponding temperature sensor (refer to JP-A-2014-081424).

However, in the related art, since each target temperature of each heat source is a fixed value, when the temperature rapidly increases in each heat source, overshoot may be caused.

SUMMARY

An object of the present disclosure is provide an image forming apparatus and a control method of the image forming apparatus capable of suppressing overshoot in each of a plurality of heat sources.

One illustrative aspect provides an image forming apparatus having:

a process unit configured to form a developer image on a sheet;

a heating member configured to heat a sheet;

a pressing member configured to press a sheet between the heating member and the pressing member;

a first heat source configured to heat the heating member;

a second heat source configured to heat the heating member;

a first temperature detector configured to detect a temperature of a first region including a central portion of the heating member in a width direction;

a second temperature detector configured to detect a temperature of a second region closer to an end portion than the first region of the heating member; and a controller configured to execute:

first supplying processing of supplying a current to the first heat source based on a detection result of the first temperature detector such that the temperature of the first region reaches a first target temperature, and of increasing the first target temperature with a first gradient toward a first fixing temperature at which a developer image is fixed on a sheet; and second supplying processing of supplying a current to the second heat source based on a detection result of the second temperature detector such that the temperature of the second region reaches a second target temperature, and of increasing the second target temperature with a second gradient toward a second fixing temperature at which a developer image is fixed on a sheet, in which in the first region, an output of the first heat source is larger than an output of the second heat source, and in the second region, an output of the second heat source is larger than an output of the first heat source.

The aspect provides a control method of an image forming apparatus having:

a process unit configured to form a developer image on a sheet;

a heating member configured to heat a sheet;

a pressing member configured to press a sheet between the heating member and the pressing member;

a first heat source configured to heat the heating member; and a second heat source configured to heat the heating member, in which in a first region including a central portion of the heating member, an output of the first heat source is larger than an output of the second heat source, in a second region closer to an end portion than the first region of the heating member, an output of the second heat source is larger than an output of the first heat source, and the control method having:

a first supplying processing step of supplying a current to the first heat source based on a temperature of the first region such that the temperature of the first region reaches a first target temperature, and of increasing the first target temperature with a first gradient toward a first fixing temperature at which a developer image is fixed on a sheet; and second supplying processing step of supplying a current to the second heat source based on a temperature of the second region such that the temperature of the second region reaches a second target temperature, and of increasing the second target temperature with a second gradient toward a second fixing temperature at which a developer image is fixed on a sheet.

The aspect provides an image forming apparatus having:

a process unit configured to form a developer image on a sheet;

a heating member configured to heat a sheet;

a pressing member configured to press a sheet between the heating member and the press member;

a first heat source having a first filament and configured to heat the heating member;

a second heat source having a second filament and configured to heat the heating member;

a first temperature detector configured to detect a temperature of a first region including a central portion of the heating member in a width direction;

a second temperature detector configured to detect a temperature of a second region closer to an end portion than the first region of the heating member; and a controller configured to execute:

first supplying processing of supplying a current to the first heat source based on a detection result of the first temperature detector such that the temperature of the first region reaches a first target temperature, and of increasing the first target temperature with a first gradient toward a first fixing temperature at which a developer image is fixed on a sheet; and second supplying processing of supplying a current to the second heat source based on a detection result of the second temperature detector such that the temperature of the second region reaches a second target temperature, and of increasing the second target temperature with a second gradient toward a second fixing temperature at which a developer image is fixed on a sheet, in which in the first region, a density of the first filament is higher than a density of the second filament, and in the second region, a density of the second filament is higher than a density of the first filament.

The aspect provides an image forming apparatus having:

a photosensitive drum;

a heating roller for heating a sheet;

a pressing roller for pressing a sheet between the heating roller and the pressing roller;

a first halogen heater for heating the heating roller;

a second halogen heater for heating the heating roller;

a first sensor for detecting a temperature of a first region including a central portion of the heating roller;

a second sensor for detecting a temperature of a second region closer to an end portion than the first region of the heating roller;

a controller configured to execute:

first supplying processing of supplying a current to the first halogen heater based on a detection result of the first sensor such that the temperature of the first region reaches a first target temperature, and of increasing the first target temperature with a first gradient toward a first fixing temperature at which a developer image is fixed on a sheet; and second supplying processing of supplying a current to the second halogen heater based on a detection result of the second sensor such that the temperature of the second region reaches a second target temperature, and of increasing the second target temperature with a second gradient toward a second fixing temperature at which a developer image is fixed on a sheet, in which in the first region, an output of the first halogen heater is larger than an output of the second halogen heater, and in the second region, an output of the second heat source is larger than an output of the first halogen heater.

According to the above configuration, the first target temperature is increased with the first gradient and the second target temperature is increased with the second gradient, so that the temperatures of the two heat sources increase with the gentle the gradients. Therefore, it is possible to reduce the overshoot in each heat source.

The first gradient and the second gradient may be different from each other.

According to the above configuration, the first gradient and the second gradient are configured to be different from each other, so that it is possible to suppress the two heat sources from reaching the fixing temperature at the same time. Therefore, it is possible to suppress a situation where the temperature of the heating member is lowered by the sheet and a fixing defect is thus caused.

The second fixing temperature may be lower than the first fixing temperature, and the second gradient may be smaller than the first gradient.

According to the above configuration, it is possible to reduce a degree of the overshoot in the heat source of which the fixing temperature is lower, as compared to the heat source in which the fixing temperature is higher.

In the first supplying processing, the controller may be configured to change a current to the first heat source such that the smaller a first deviation between the temperature of the first region and the first target temperature is, the smaller the current to the first heat source is.

According to the above configuration, it is possible to favorably approximate the temperature of the first region to the first target temperature increasing with the first gradient.

In the first supplying processing, the controller may be configured to stepwise increase the first target temperature to increase the first target temperature with the first gradient.

In the second supplying processing, the controller may be configured to change a current to the second heat source such that the smaller a second deviation between the temperature of the second region and the second target temperature is, the smaller the current to the second heat source is.

According to the above configuration, it is possible to favorably approximate the temperature of the second region to the second target temperature increasing with the second gradient.

In the second supplying processing, the controller may be configured to stepwise increase the second target temperature to increase the second target temperature with the second gradient.

In the first supplying processing, the controller may be configured to set the first target temperature to a first initial temperature lower than the first fixing temperature when the controller starts supplying a current to the first heat source, and increase the first target temperature with the first gradient based on a condition that the temperature of the first region reaches a first switching temperature lower than the first initial temperature.

In the second supplying processing, the controller may be configured to set the second target temperature to a second initial temperature lower than the second fixing temperature when the controller starts supplying a current to the second heat source, and increase the second target temperature with the second gradient based on a condition that the temperature of the second region reaches a second switching temperature lower than the second initial temperature.

According to the present disclosure, it is possible to suppress the overshoot in each of the plurality of heat sources.

DETAILED DESCRIPTION

Hereinafter, an illustrative embodiment of the present disclosure will be described in detail with reference to the drawings.

Figure 1:
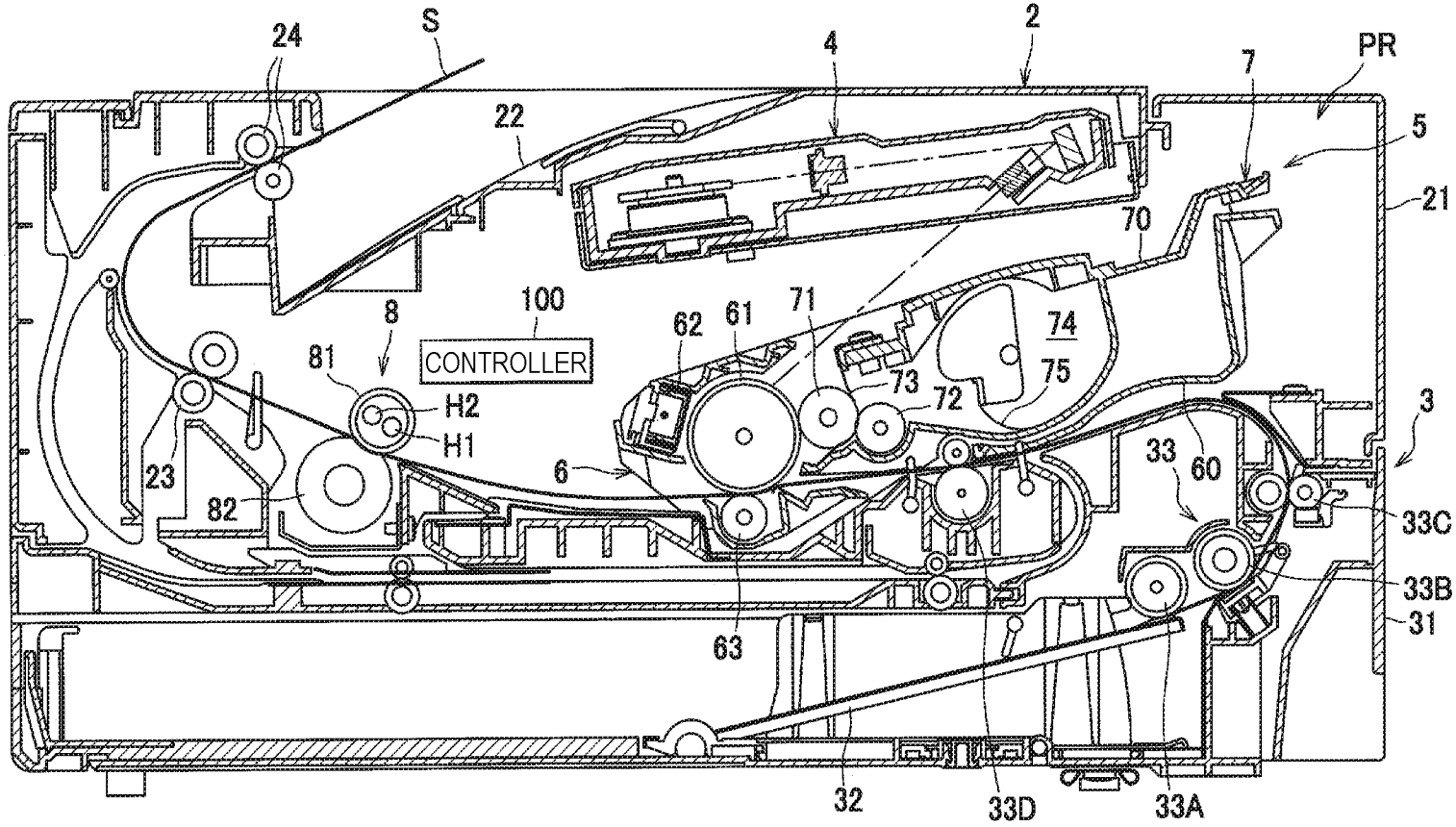
FIG. 1 depicts a laser printer in accordance with an illustrative embodiment.

As shown in FIG. 1, a laser printer 1 is an example of the image forming apparatus configured to form an image on a sheet S, and includes, in a body housing 2, a feeder unit 3, a process unit PR, a fixing device 8, and a controller 100.

The feeder unit 3 is a mechanism for feeding a sheet S to the process unit PR, and is provided at a lower part in the body housing 2. The feeder unit 3 includes a feeder tray 31 for accommodating therein the sheet S, a sheet pressing plate 32, and a feeder mechanism 33. The feeder mechanism 33 includes a pickup roller 33A, a separation roller 33B, first conveyance rollers 33C, and register rollers 33D. In the feeder unit 3, the sheet S in the feeder tray 31 is approximated to the pickup roller 33A by the sheet pressing plate 32 and is sent to the separation roller 33B by the pickup roller 33A. The sheet S is separated one by one by the separation roller 33B and is conveyed by the first conveyance rollers 33C. The register rollers 33D are configured to align a position of a tip end of the sheet S and then to convey the sheet S toward the process unit PR. Here, a direction in which the sheet S is conveyed is referred to as a conveying direction, and a direction perpendicular to the conveying direction in a plane of the sheet S is referred to as a width direction.

The process unit PR has a function of forming a developer image on the sheet S. The process unit PR includes an exposure device 4 and a process cartridge 5.

The exposure device 4 is arranged at an upper part in the body housing 2, and includes a laser light source (not shown), and a polygon mirror, a lens, a reflector and the like of which reference numerals are omitted. In the exposure device 4, a laser light emitted from the laser light source on the basis of image data is scanned on a surface of the photosensitive drum 61, thereby exposing the surface of the photosensitive drum 61.

The process cartridge 5 is arranged below the exposure device 4, and can be mounted and demounted to and from the body housing 2 through an opening, which is formed when a front cover 21 provided to the body housing 2 is opened. The process cartridge 5 includes a drum unit 6 and a developing unit 7.

The drum unit 6 includes a photosensitive drum 61, a charger 62, and a transfer roller 63. The developing unit 7 can be detachably mounted to the drum unit 6, and includes a developing roller 71, a supply roller 72, a layer thickness regulation blade 73, a developer accommodation part 74 configured to accommodate therein developer, which is dry toner, and an agitator 75.

In the process cartridge 5, a surface of the photosensitive drum 61 is uniformly charged by the charger 62 and is then exposed by the laser light emitted from the exposure device 4, so that an electrostatic latent image based on the image data is formed on the photosensitive drum 61. Also, the developer in the developer accommodation part 74 is stirred by the agitator 75, is supplied to the developing roller 71 via the supply roller 72 and is introduced between the developing roller 71 and the layer thickness regulation blade 73 in conjunction with rotation of the developing roller 71, so that it is carried on the developing roller 71, as a thin layer having a predetermined thickness.

The developer carried on the developing roller 71 is supplied from the developing roller 71 to the electrostatic latent image formed on the photosensitive drum 61. Thereby, the electrostatic latent image becomes visible, so that a developer image is formed on the photosensitive drum 61. Thereafter, the sheet S supplied from the feeder unit 3 is conveyed between the photosensitive drum 61 and the transfer roller 63, so that the developer image formed on the photosensitive drum 61 is transferred to the sheet S.

The fixing device 8 is a device configured to fix the developer image on the sheet S being conveyed from the process unit PR. The fixing device 8 includes a heating member 81 configured to heat the sheet S and a pressing member 82 configured to press the sheet S between the heating member 81 and the pressing member 82.

The heating member 81 is a cylindrical rotatable heating roller and is made of metal or the like. In the heating member 81, a first heat source H1 and a second heat source H2 for heating the heating member 81 are provided. The pressing member 82 is a rotatable pressing roller and has an elastic layer made of elastically deformable rubber or the like and provided on a surface thereof. In the fixing device 8, the sheet S having the developer image transferred thereon is conveyed between the heating member 81 and the pressing member 82, so that the developer image is heat-fixed on the sheet S. The sheet S having the developer image heat-fixed thereon is discharged onto a discharge tray 22 by second conveyance rollers 23 and discharge rollers 24.

Figure 2:
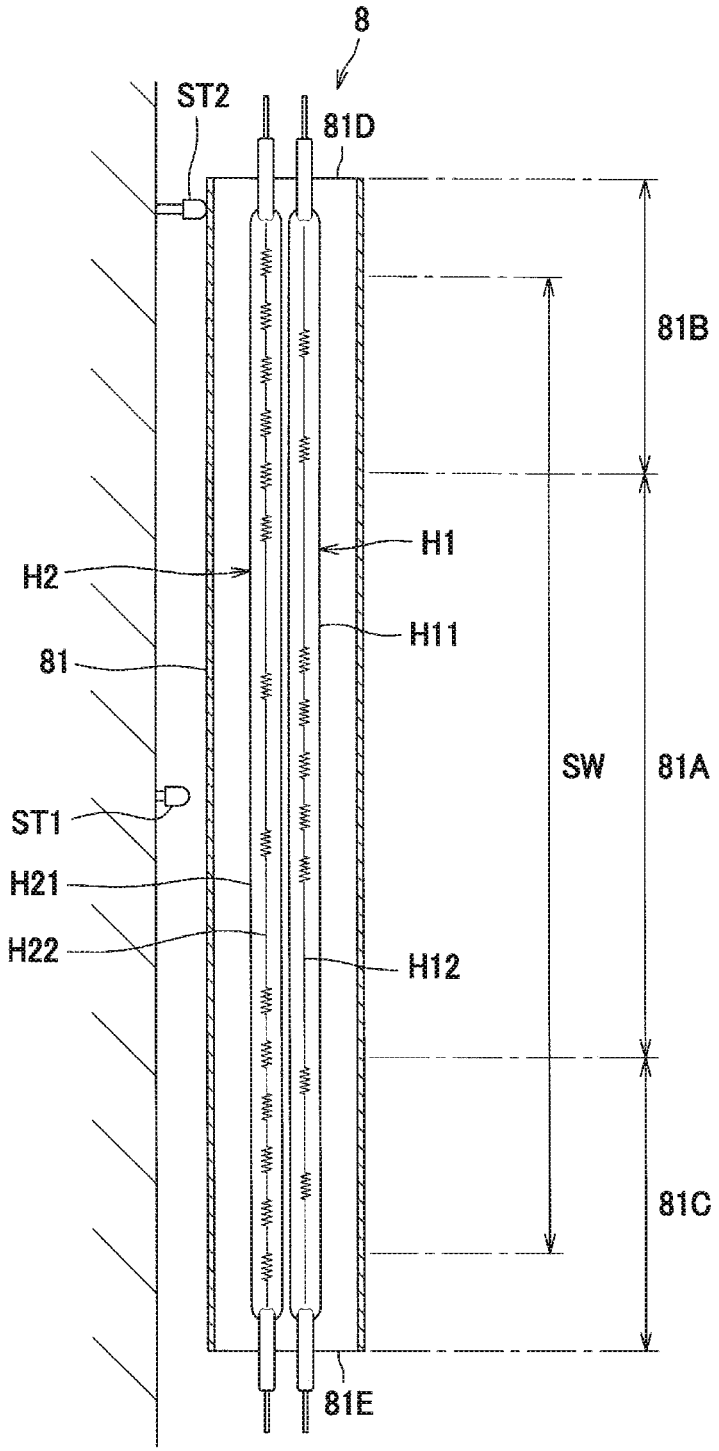
FIG. 2 depicts a fixing device.

As shown in FIG. 2, the fixing device 8 further includes a first temperature detector ST1 and a second temperature detector ST2, in addition to the heating member 81, the first heat source H1 and the second heat source H2.

Figure 3:
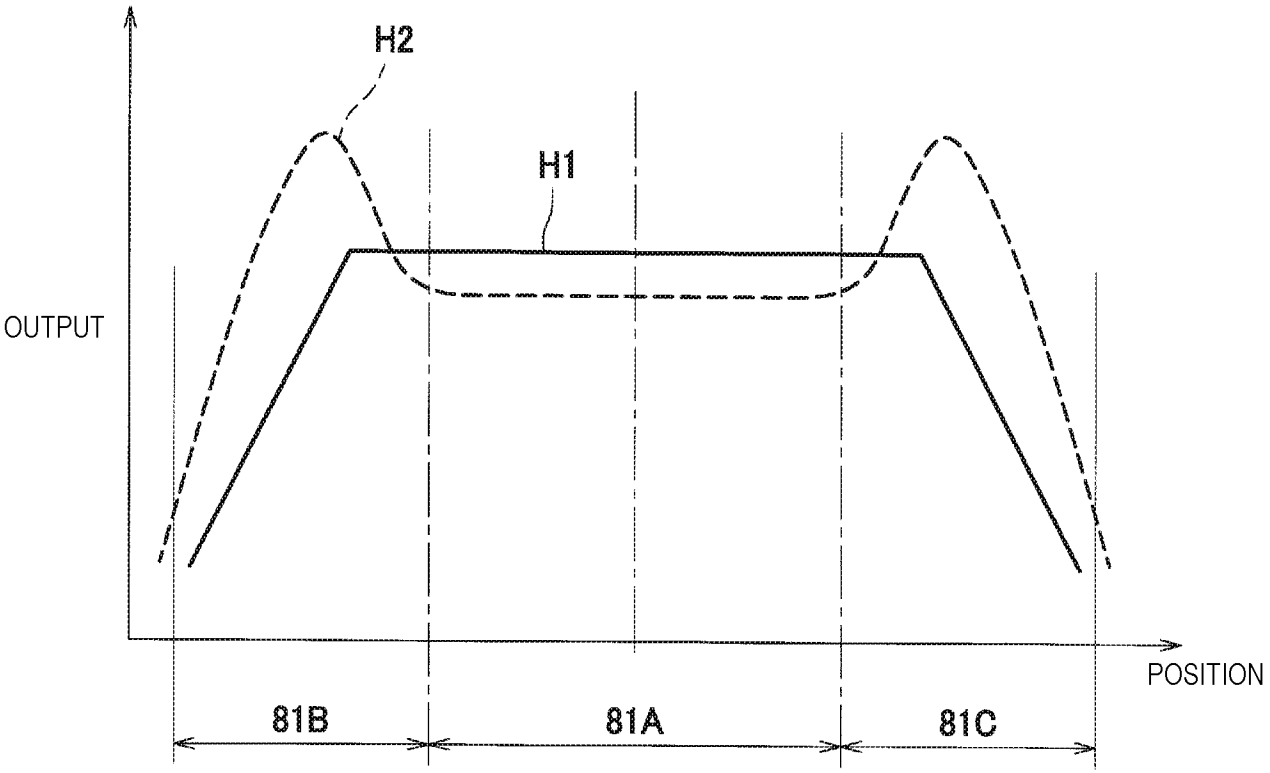
FIG. 3 depicts an output of each heat source.

The first heat source H1 is a halogen lamp and has an output peak in a first region 81A including a central portion of the heating member 81 in the width direction (refer to FIG. 3). The first heat source H1 includes a glass tube H11 and a filament H12 provided in the glass tube H11. The filament H12 has more light-emitting units at a central part in the width direction, as compared to each end part in the width direction. The more light-emitting units in the filament H12, the higher a density of the filament H12 is.

The second heat source H2 is a halogen lamp and has output peaks in second regions 81B, 81C closer to end portions than the first region 81A of the heating member 81 (refer to FIG. 3). The second heat source H2 includes a glass tube H21 and a filament H22 provided in the glass tube H21. The filament H22 has more light-emitting units at each end part in the width direction, as compared to the central part in the width direction. The more light-emitting units in the filament H22, the higher a density of the filament H22 is.

In the first region 81A, the density of the filament H12 is higher than the density of the filament H22. In the second regions 81B, 81C, the density of the filament H22 is higher than the density of the filament H12.

Here, the width direction of the heating member 81 is a direction along a rotation axis of the heating member 81, and means the same direction as the width direction of the sheet S. The first region 81A of the heating member 81 is a range including a center of the heating member 81 in the width direction, and the second region 81B located at one end-side of the heating member 81 is a range between an end edge 81D located at one end-side of the heating member 81 and the first region 81A. The second region 81C located at the other end-side of the heating member 81 is a range between an end edge 81E located at the other end-side of the heating member 81 and the first region 81A.

As shown with the solid line in FIG. 3, an output of the first heat source H1 is highest at the center in the width direction, and gradually decreases toward both ends in the width direction. Thereby, the first heat source H1 has heating performance that is higher in the first region 81A of the heating member 81 than in the second regions 81B, 81C. As shown with the broken line, an output of the second heat source H2 is higher at the ends than at the center in the width direction. Thereby, the second heat source H2 has heating performance that is higher in the second regions 81B, 81C of the heating member 81 than in the first region 81A. A range in which the output of the first heat source H1 is highest and a range in which the output of the second heat source H2 is highest are set not to overlap each other.

The output of the first heat source H1 in the second regions 81B, 81C is 30% or less of the output in the first region 81A, and the output of the second heat source H2 in the first region 81A is 80% or less of the output of the second regions 81B, 81C.

In the meantime, as a method of detecting the output of each of the heat sources H1, H2, a method of arranging an optical sensor configured to detect light of a heat source at a position spaced at a predetermined distance from the heat source and detecting an amount of the light may be exemplified. Here, the predetermined distance is a distance from the heat source to an inner peripheral surface of the heating member 81.

As shown in FIG. 2, the first temperature detector ST1 is a sensor configured to detect a temperature of the first region 81A of the heating member 81. The first temperature detector ST1 is configured to be in contactless with the heating member 81. Specifically, the first temperature detector ST1 is arranged with an interval from an outer peripheral surface of the heating member 81.

The second temperature detector ST2 is a sensor configured to detect a temperature of the second region 81B located at one end-side of the heating member 81. The second temperature detector ST2 is configured to be in contact with the second region 81B of the heating member 81. The second temperature detector ST2 is offset toward the end edge 81D of one end-side from a maximum region SW of the sheet S that can be fixed by the fixing device 8.

In the meantime, as the first temperature detector ST1 and the second temperature detector ST2, a thermistor and the like can be used, for example.

Figure 4:
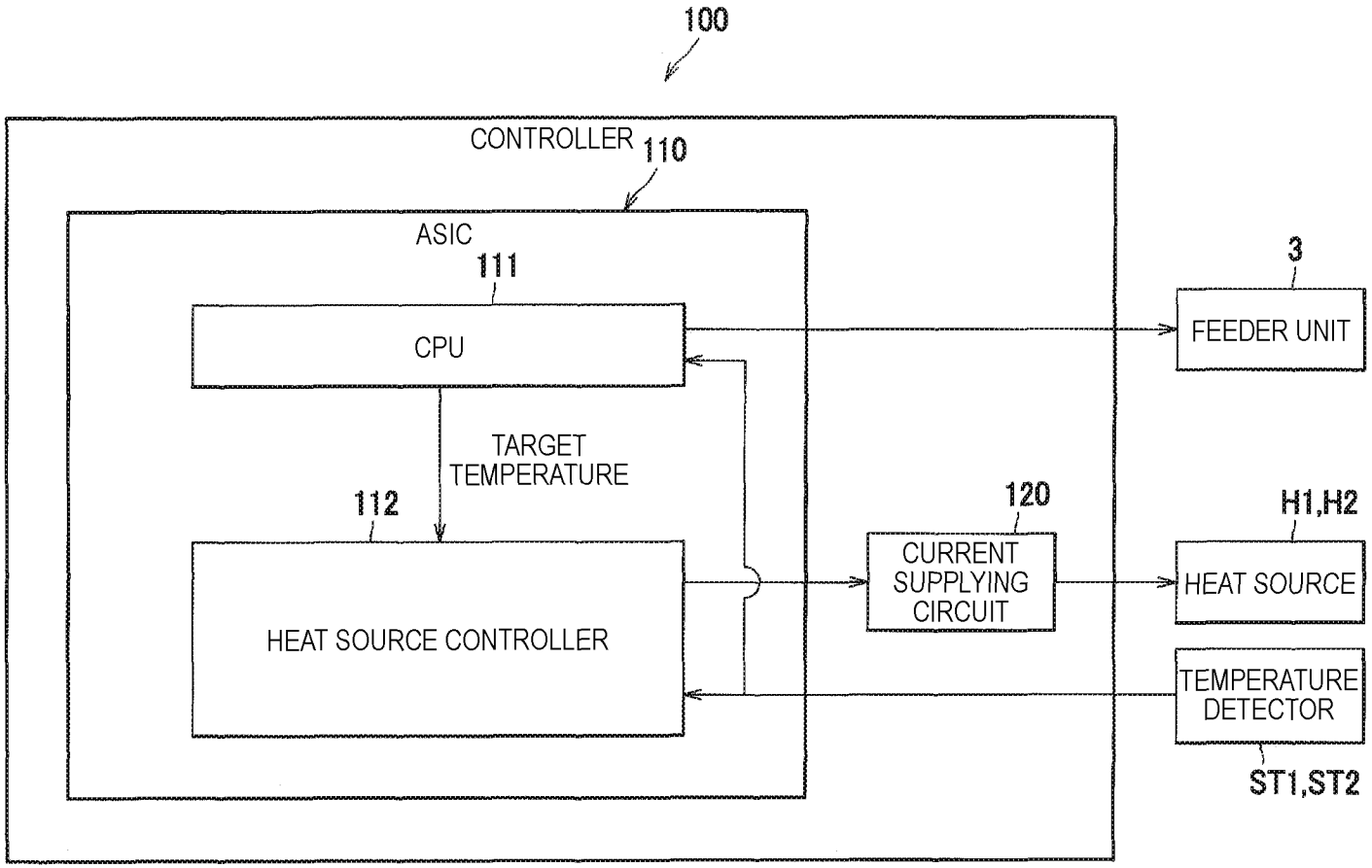
FIG. 4 is a block diagram depicting a configuration of a controller.

As shown in FIG. 4, the controller 100 includes an ASIC 110 and a current-supplying circuit 120. The ASIC 110 includes a CPU 111 and a heat source controller 112. The current-supplying circuit 120 is a circuit including a switching circuit for switching an input alternating current voltage between an applying state and a non-applying state, and the like, and is connected to each of the heat sources H1, H2 and the ASIC 110.

The CPU 111 is mounted in the ASIC 110, as a function. The CPU 111 is configured to control drive and stop of the feeder unit 3 and to output a first target temperature TP1 and a second target temperature TP2, which are target temperatures of the first region 81A and the second region 81B, to the heat source controller 112. The first target temperature TP1 and the second target temperature TP2 are command values in feedback processing when the heat source controller 112 executes current-supplying control on the first heat source H1 and the second heat source H2.

The heat source controller 112 is a function or circuit incorporated in the ASIC 110, and is configured to control the current-supplying circuit 120 so that detected temperatures Ts1, Ts2 of the temperature detectors ST1, ST2 are to be the target temperatures, thereby energizing each of the heat sources H1, H2. Specifically, the heat source controller 112 is configured to executing feedback processing of determining a duty ratio of an alternating current voltage to be energized to each of the heat sources H1, H2 on the basis of the detected temperatures Ts1, Ts2 and the target temperatures and controlling the current-supplying circuit 120 with the determined duty ratio. In the meantime, the feedback processing that is to be executed by the heat source controller 112 may be mounted in an external chip of the ASIC 110 or may be executed by the CPU 111.

The controller 100 has a function of executing first supplying processing of controlling a current supply to the first heat source H1, that is, controlling a supply of a current to the first heat source H1. The controller 100 also has a function of executing second supplying processing of controlling a current supply to the second heat source H2, that is, controlling a supply of a current to the second heat source H2.

The first supplying processing is processing of controlling the supply of the current to the first heat source H1 so as to increase the temperature of the first region 81A toward a first fixing temperature TH1 at which a developer image is fixed on the sheet S, based on a detection result of the first temperature detector ST1. Specifically, in the first supplying processing, the controller 100 is configured to control the supply of the current to the first heat source H1 so that the temperature of the first region 81A, i.e., a first detected temperature Ts1, which is a detected temperature of the first temperature detector ST1, is to be the first target temperature TP1, which is equal to or lower than the first fixing temperature TH1, and to increase the first target temperature TP1 toward the first fixing temperature TH1 with a first gradient A1 (refer to FIG. 7).

Figure 7:
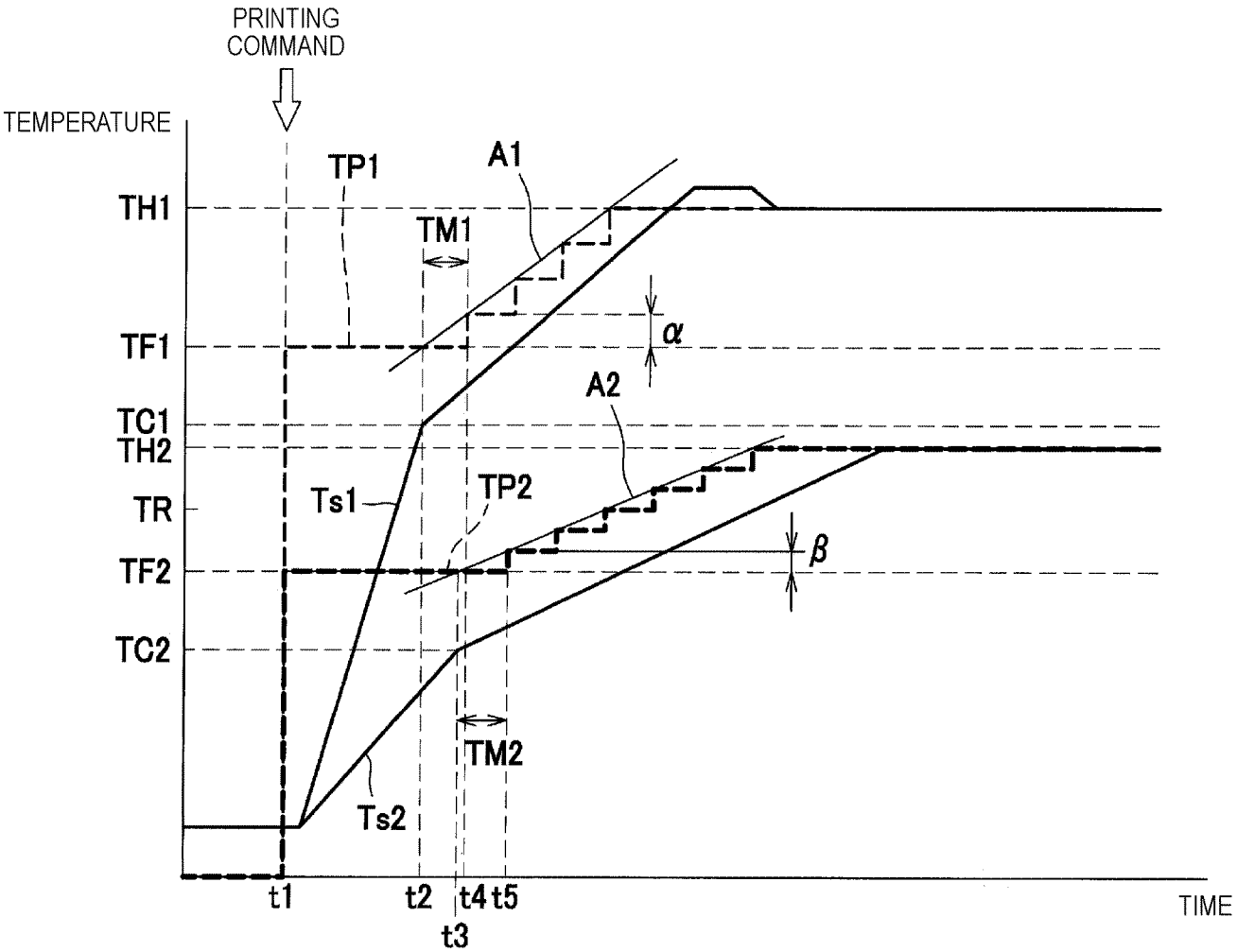
FIG. 7 is a timing chart depicting an example of an operation of the controller.

More specifically, as shown in FIG. 7, in the first supplying processing, when starting the current supply, the controller 100 sets the first target temperature TP1 to a first initial temperature TF1 lower than the first fixing temperature TH1. Also, when the first detected temperature Ts1 becomes a first switching temperature TC1 lower than the first initial temperature TF1, the controller 100 stepwise increases the first target temperature TP1 to increase the first target temperature TP1 with the first gradient A1.

Also, in the first supplying processing, the controller 100 is configured to change a current to the first heat source H1 so that the smaller a first deviation is, which is a deviation between the first detected temperature Ts1 and the first target temperature TP1, the smaller the current to the first heat source H1 is. Also, in the first supplying processing, when the first detected temperature Ts1 becomes equal to or higher than the first target temperature TP1, the controller 100 stops the supply of the current to the first heat source H1.

The second supplying processing is processing of controlling the supply of the current to the second heat source H2 so as to increase the temperature of the second region 81B toward a second fixing temperature TH2 at which a developer image is fixed on the sheet S, based on a detection result of the second temperature detector ST2. The second fixing temperature TH2 is set to a temperature lower than the first fixing temperature TH1.

In the second supplying processing, the controller 100 is configured to control the supply of the current to the second heat source H2 so that the temperature of the second region 81B, i.e., a second detected temperature Ts2, which is a detected temperature of the second temperature detector ST2, is to be the second target temperature TP2, which is equal to or lower than the second fixing temperature TH2, and to increase the second target temperature TP2 toward the second fixing temperature TH2 with a second gradient A2 (refer to FIG. 7). The second gradient A2 is set to a gradient smaller than the first gradient A1.

More specifically, as shown in FIG. 7, in the second supplying processing, when starting the current supply, the controller 100 sets the second target temperature TP2 to a second initial temperature TF2 lower than the second fixing temperature TH2. Also, when the second detected temperature Ts2 becomes a second switching temperature TC2 lower than the second initial temperature TF2, the controller 100 stepwise increases the second target temperature TP2 to increase the second target temperature TP2 with the second gradient A2.

Also, in the second supplying processing, the controller 100 is configured to change a current to the second heat source H2 so that the smaller a second deviation is, which is a deviation between the second detected temperature Ts2 and the second target temperature TP2, the smaller the current to the second heat source H2 is. Also, in the second supplying processing, when the second detected temperature Ts2 becomes equal to or higher than the second target temperature TP2, the controller 100 stops the supply of the current to the second heat source H2.

In the meantime, the parameters of the fixing temperatures TH1, TH2, the initial temperatures TF1, TF2, the switching temperatures TC1, TC2, the gradients A1, A2 and the like may be appropriately set on the basis of tests, simulations and the like.

Subsequently, operations of the controller 100 are described in detail.

When a printing command is received, the controller 100 turns on both the first heat source H1 and the second heat source H2 so as to set the heating member 81 to the fixing temperature. At this time, the controller 100 executes the first supplying processing shown in FIGS. 5A and 5B and the second supplying processing shown in FIGS. 6A and 6B at the same time.

Figure 5A:
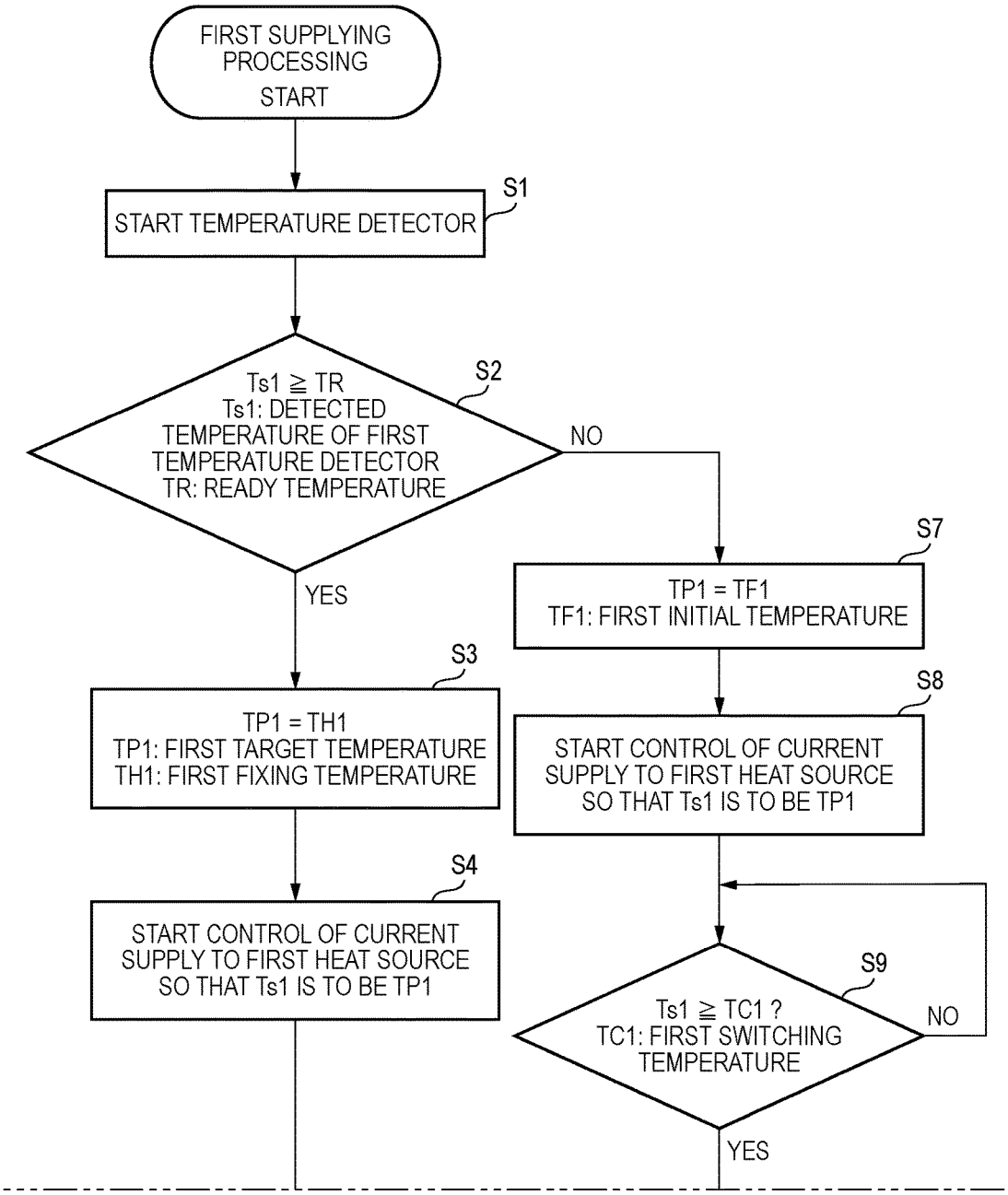
FIGS. 5A and 5B are flowcharts depicting first supplying processing.
Figure 5B:
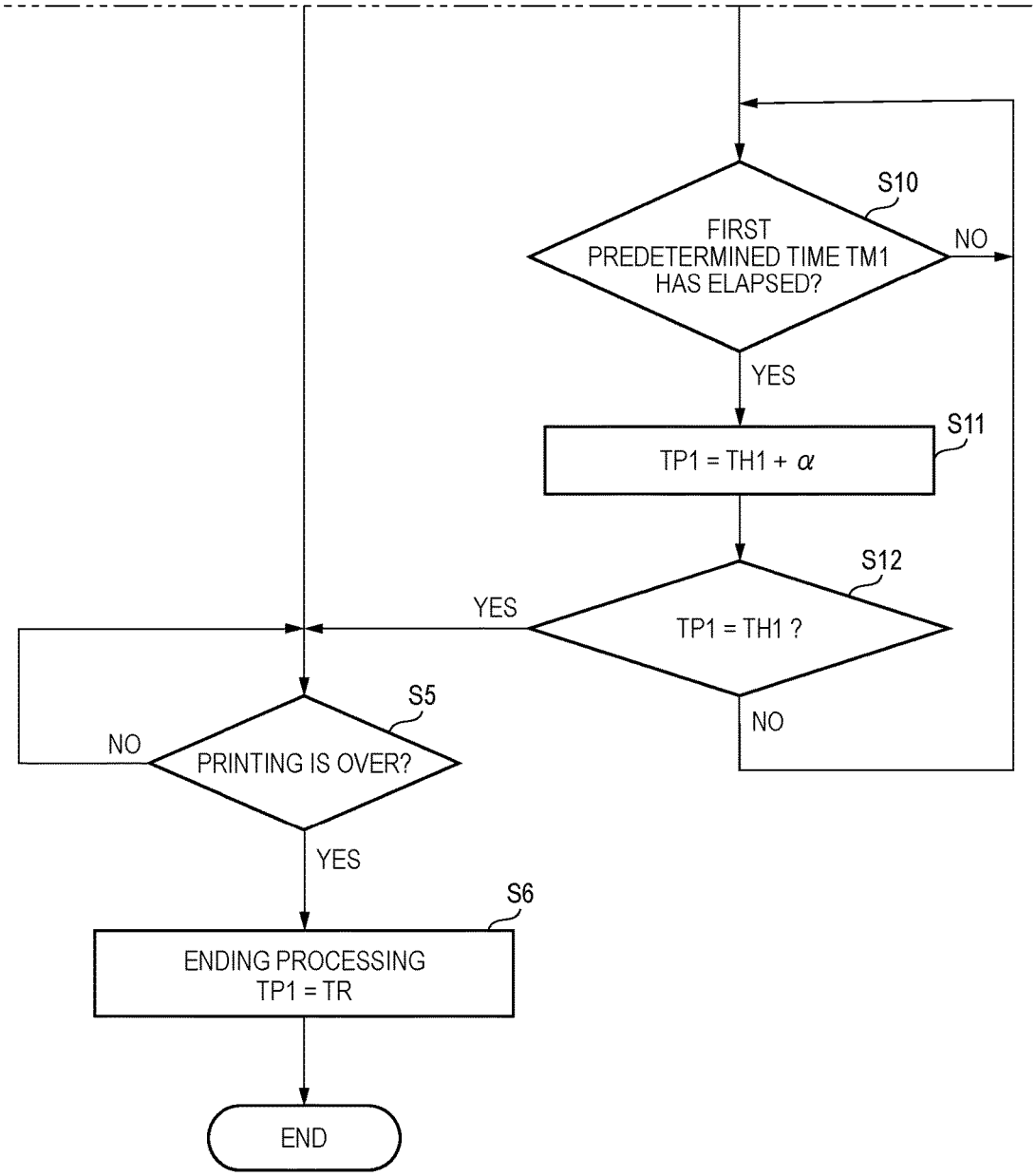

As shown in FIGS. 5A and 5B, in the first supplying processing, the controller 100 first starts to detect the first detected temperature Ts1 by the first temperature detector ST1 (S1). After step S1, the controller 100 determines whether the first detected temperature Ts1 is equal to or higher than a ready temperature TR (S2).

Here, the ready temperature TR is a target temperature of the heating member 81 in a ready mode for setting a state of the laser printer 1 to a state where the laser printer can promptly perform a printing operation with the printing command. In the ready mode, the controller 100 controls supply of a current to the first heat source H1 or the second heat source H2 so that the temperature of the heating member 81 is to be the ready temperature TR.

When it is determined in step S2 that a relation of Ts1≥TR is satisfied (Yes), the controller 100 sets the first target temperature TP1 to the first fixing temperature TH1 (S3), and starts control of the current supply to the first heat source H1 so that the first detected temperature Ts1 is to be the first target temperature TP1, i.e., the first fixing temperature TH1 (S4). When predetermined time elapses after starting the control so that the first detected temperature Ts1 is to be the first fixing temperature TH1 in step S4, the controller 100 delivers the sheet S from the feeder unit 3, forms the developer image on the sheet S by the process unit PR, and fixes the developer image on the sheet S by the fixing device 8. The predetermined time is set to a timing at which, when the control is continuously performed so that the first detected temperature Ts1 is to be the first fixing temperature TH1, the heating member 81 reaches the fixing temperature at the time that the sheet S delivered from the feeder unit 3 passes through the fixing device 8.

After step S4, the controller 100 determines whether a printing job included in the printing command is over (S5). When it is determined in step S5 that the printing job included in the printing command is not over (No), the controller 100 continues to perform the control having started in step S4. When it is determined in step S5 that the printing job included in the printing command is over (Yes), the controller 100 executes ending processing (S6), and ends the control. In step S6, the controller 100 sets the first target temperature TP1 to the ready temperature TR, and when there is no printing command within predetermined time, the controller 100 sets the first target temperature TP1 to 0° C., thereby stopping the supply of the current to the first heat source H1.

When it is determined in step S2 that the relation of Ts1≥TR is not satisfied (No), the controller 100 sets the first target temperature TP1 to the first initial temperature TF1 (S7), and starts control of the current supply to the first heat source H1 so that the first detected temperature Ts1 is to be the first target temperature TP1, i.e., the first initial temperature TF1 (S8).

After step S8, the controller 100 determines whether the first detected temperature Ts1 is equal to or higher than the first switching temperature TC1 (S9). When it is determined in step S9 that a relation of Ts1≥TC1 is not satisfied (No), the controller 100 continues to perform the control while keeping the first target temperature TP1 to the first initial temperature TF1.

When it is determined in step S9 that the relation of Ts1≥TC1 is satisfied (Yes), the controller 100 determines whether first predetermined time TM1 has elapsed after the first detected temperature Ts1 becomes equal to or higher than the first switching temperature TC1 (S10). When it is determined in step S10 that the first predetermined time TM1 has elapsed (Yes), the controller 100 sets a value obtained by adding a first predetermined temperature α to the first target temperature TP1, as a new first target temperature TP1 (S11). That is, in step S11, the controller 100 stepwise increases the first target temperature TP1.

Meanwhile, in step S10, the controller 100 determines whether the elapsed time measured by a timer, for example, is equal to or longer than the first predetermined time TM1. When shifting from step S8 to step S9, the controller 100 starts measurement by the timer. When the elapsed time measured by the timer is equal to or longer than the first predetermined time TM1, the controller 100 resets the timer and again starts the measurement by the timer.

In step S11, when the first detected temperature Ts1 becomes a predetermined temperature, the controller 100 delivers the sheet S from the feeder unit 3, forms the developer image on the sheet S by the process unit PR, and fixes the developer image on the sheet S by the fixing device 8. The predetermined temperature is set to a temperature at which, when the control is continuously performed, the heating member 81 can reach the fixing temperature at the time that the sheet S delivered from the feeder unit 3 passes through the fixing device 8.

After step S11, the controller 100 determines whether the first target temperature TP1, to which the first predetermined temperature α was added in step S11, becomes the first fixing temperature TH1 (S12). When it is determined in step S12 that a relation of TP1=TH1 is not satisfied (No), the controller 100 returns to step S10. That is, the controller 100 stepwise increases the first target temperature TP1 every first predetermined time TM1 until the first target temperature TP1 becomes the first fixing temperature TH1, thereby increasing the first target temperature TP1 with the first gradient A1. Also, the controller 100 continues to perform the control on the basis of the first target temperature TP1 increasing with the first gradient A1.

The first gradient A1 can be expressed by a following equation (1).

$$A1=\alpha/TM1 \tag{1}$$

Also, the first predetermined temperature α can be expressed by a following equation (2).

$$\alpha=(TH1-TF1)/n \tag{2}$$

n: integer

When it is determined in step S12 that the relation of TP1=TH1 is satisfied (Yes), the controller 100 determines whether the printing job included in the printing command is over (S5). When it is determined in step S5 that the printing job included in the printing command is not over (No), the controller 100 continues to perform the control on the basis of the first target temperature TP1 set to the first fixing temperature TH1. When it is determined in step S5 that the printing job included in the printing command is over (Yes), the controller 100 executes the ending processing (S6).

Figure 6A:
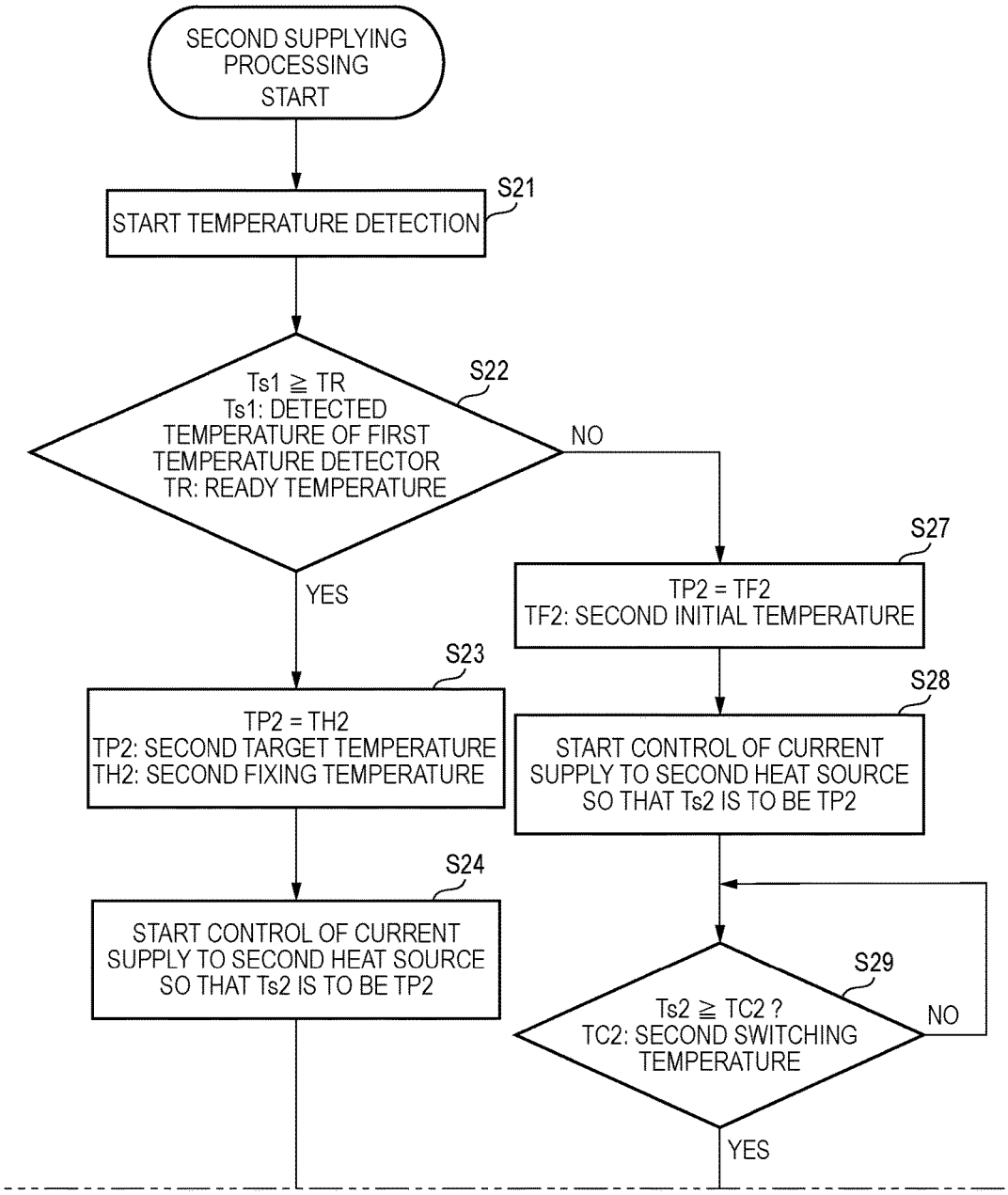
FIGS. 6A and 6B are flowcharts depicting second supplying processing.
Figure 6B:
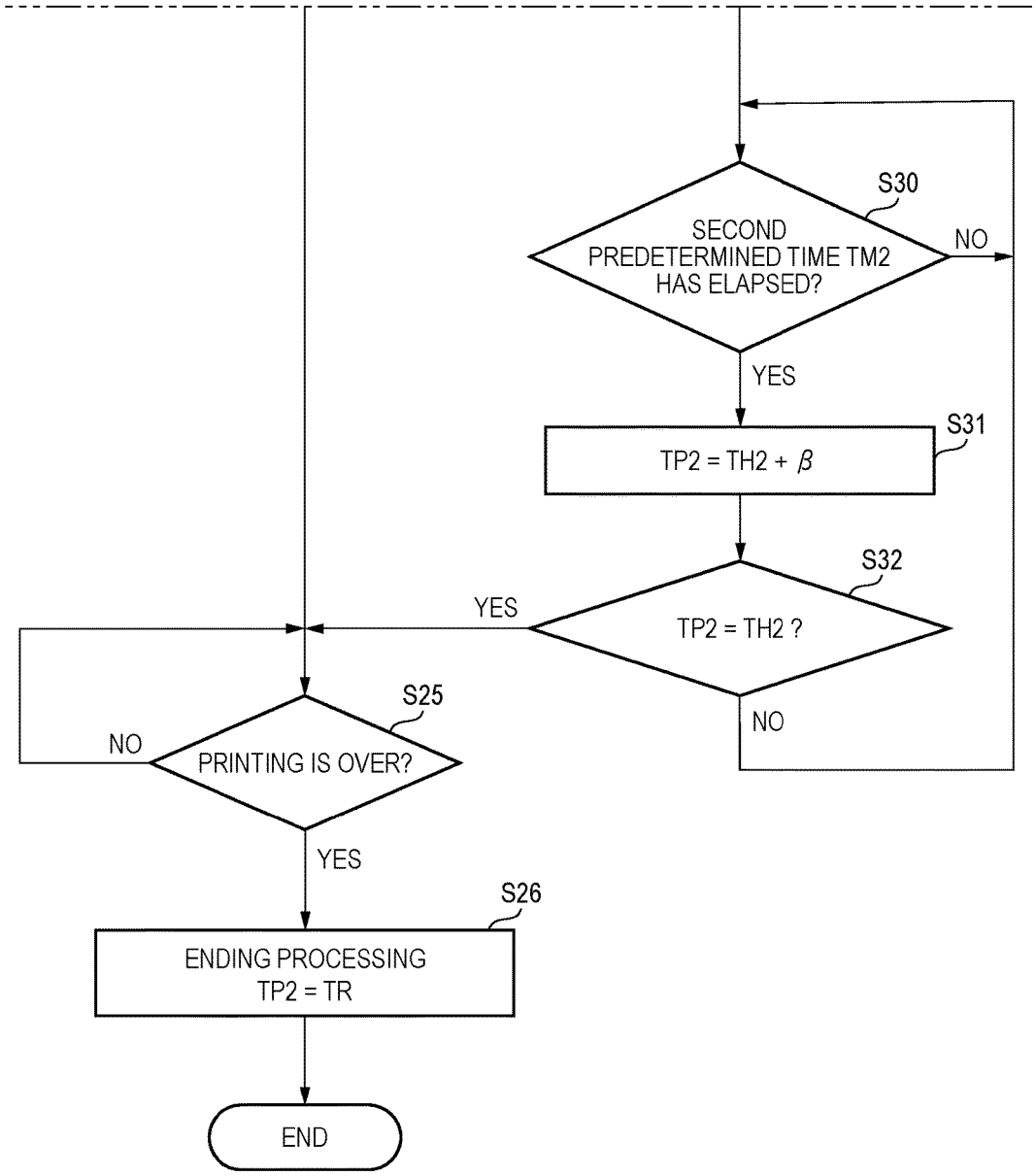

Since the second supplying processing shown in FIGS. 6A and 6B is the same processing as the first supplying processing shown in FIGS. 5A and 5B, it is described in brief.

As shown in FIGS. 6A and 6B, in the second supplying processing, the controller 100 first executes processing of steps S21, S22, which is the same processing as the processing of steps S1, S2.

When it is determined in step S22 that the relation of Ts1≥TR is satisfied (Yes), the controller 100 sets the second target temperature TP2 to the second fixing temperature TH2 (S23), and starts control of the current supply to the second heat source H2 so that the second detected temperature Ts2 is to be the second target temperature TP2, i.e., the second fixing temperature TH2 (S24).

After step S24, the controller 100 determines whether the printing job included in the printing command is over (S25). When it is determined in step S25 that the printing job included in the printing command is not over (No), the controller 100 continues to perform the control. When it is determined in step S25 that the printing job included in the printing command is over (Yes), the controller 100 executes the ending processing (S26), and ends the control. In step S26, the controller 100 sets the second target temperature TP2 to the ready temperature TR, and when there is no printing command within predetermined time, the controller 100 sets the second target temperature TP2 to 0 degree, thereby stopping the supply of the current to the second heat source H2.

In the illustrative embodiment, the ready temperature for the first heat source H1 and the ready temperature for the second heat source H2 are set to the same temperature TR. However, the present disclosure is not limited thereto. For example, the ready temperature for the first heat source H1 and the ready temperature for the second heat source H2 may be different from each other.

When it is determined in step S22 that the relation of Ts1≥TR is not satisfied (No), the controller 100 sets the second target temperature TP2 to the second initial temperature TF2 (S27), and starts control of the current supply to the second heat source H2 so that the second detected temperature Ts2 is to be the second target temperature TP2, i.e., the second initial temperature TF2 (S28).

After step S28, the controller 100 determines whether the second detected temperature Ts2 becomes equal to or higher than the second switching temperature TC2 (S29). When it is determined in step S29 that a relation of Ts2≥TC2 is not satisfied (No), the controller 100 continues to perform the control while keeping the second target temperature TP2 to the second initial temperature TF2.

When it is determined in step S29 that the relation of Ts2≥TC2 is satisfied (Yes), the controller 100 determines whether second predetermined time TM2 has elapsed after the second detected temperature Ts2 becomes equal to or higher than the second switching temperature TC2 (S30). When it is determined in step S30 that the second predetermined time TM2 has elapsed (Yes), the controller 100 sets a value obtained by adding a second predetermined temperature β to the second target temperature TP2, as a new second target temperature TP2 (S31). That is, in step S31, the controller 100 stepwise increases the second target temperature TP2.

Meanwhile, in step S30, as described above, the controller 100 may determine whether the elapsed time measured by the timer, for example, is equal to or longer than the second predetermined time TM2. Also, the timer may be reset in the same manner.

After step S31, the controller 100 determines whether the second target temperature TP2, to which the second predetermined temperature β was added in step S31, becomes the second fixing temperature TH2 (S32). When it is determined in step S32 that a relation of TP2=TH2 is not satisfied (No), the controller 100 returns to step S30. That is, the controller 100 stepwise increases the second target temperature TP2 every second predetermined time TM2 until the second target temperature TP2 becomes the second fixing temperature TH2, thereby increasing the second target temperature TP2 with the second gradient A2. Also, the controller 100 continues to perform the control on the basis of the second target temperature TP2 increasing with the second gradient A2.

The second gradient A2 can be expressed by a following equation (3).

$$A2=\beta/TM2 \tag{3}$$

Also, the second predetermined temperature β can be expressed by a following equation (4).

$$\beta=(TH2-TF2)/m \tag{4}$$

m: integer

When it is determined in step S32 that the relation of TP2=TH2 is satisfied (Yes), the controller 100 proceeds to processing of step S25.

Subsequently, an example of the operation of the controller 100 is described in detail.

As shown in FIG. 7, while the first detected temperature Ts1 is lower than the ready temperature TR, when the printing command is received (time t1), the controller 100 sets the first target temperature TP1 to the first initial temperature TF1 and sets the second target temperature TP2 to the second initial temperature TF2. Then, the controller 100 controls the supply of the current to the first heat source H1, based on the first deviation, which is the deviation between the first detected temperature Ts1 and the first target temperature TP1, and controls the supply of the current to the second heat source H2, based on the second deviation, which is the deviation between the second detected temperature Ts2 and the second target temperature TP2.

When the first detected temperature Ts1 reaches the first switching temperature TC1 (time t2), the controller 100 determines whether the first predetermined time TM1 has elapsed from time t2. Likewise, when the second detected temperature Ts2 reaches the second switching temperature TC2 (time t3), the controller 100 determines whether the second predetermined time TM2 has elapsed from time t3.

When the first predetermined time TM1 has elapsed from time t2 (time t4), the controller 100 adds the first predetermined temperature α to the first target temperature TP1, thereby setting the new first target temperature TP1. Thereafter, the controller 100 adds the first predetermined temperature α every first predetermined time TM1, thereby increasing the first target temperature TP1 with the first gradient A1.

Thereby, since the temperature (the first detected temperature Ts1) of the first region 81A of the heating member 81 can be increased with a gentle gradient corresponding to the first gradient A1, it is possible to suppress the overshoot after the temperature of the first region 81A reaches the first fixing temperature TH1.

Likewise, when the second predetermined time TM2 has elapsed from time t3 (time t5), the controller 100 adds the second predetermined temperature β to the second target temperature TP2, thereby setting the new second target temperature TP2. Thereafter, the controller 100 adds the second predetermined temperature β every second predetermined time TM2, thereby increasing the second target temperature TP2 with the second gradient A2.

Thereby, since the temperature (the second detected temperature Ts2) of the second region 81B of the heating member 81 can be increased with a gentle gradient corresponding to the second gradient A2, it is possible to suppress the overshoot after the temperature of the second region 81B reaches the second fixing temperature TH2.

According to the illustrative embodiment, following effects can be accomplished, in addition to the above effects.

Since the second fixing temperature TH2 is set lower than the first fixing temperature TH1 and the second gradient A2 is set smaller than the first gradient A1, it is possible to reduce a degree of the overshoot in the second heat source H2 of which the fixing temperature is lower, as compared to the first heat source H1 in which the fixing temperature is higher.

In the first supplying processing, the current to the first heat source H1 is changed so that the smaller the first deviation is, which is the deviation between the temperature of the first region 81A and the first target temperature TP1, the smaller the current to the first heat source H1 is. Therefore, it is possible to favorably approximate the temperature of the first region 81A to the first target temperature TP1 increasing with the first gradient A1.

In the second supplying processing, the current to the second heat source H2 is changed so that the smaller the second deviation is, which is the deviation between the temperature of the second region 81B and the second target temperature TP2, the smaller the current to the second heat source H2 is. Therefore, it is possible to favorably approximate the temperature of the second region 81B to the second target temperature TP2 increasing with the second gradient A2.

In the meantime, the present disclosure is not limited to the above illustrative embodiment and can be implemented in diverse forms, as described below.

In the above illustrative embodiment, the second gradient A2 is set smaller than the first gradient A1. However, the present disclosure is not limited thereto. For example, the first gradient and the second gradient may be set to be the same or the second gradient A2 may be set greater than the first gradient A1. In the meantime, when the first gradient and the second gradient are set to be different from each other, it is possible to suppress the two heat sources from reaching the fixing temperature at the same time. Therefore, it is possible to suppress a situation where the temperature of the heating member is lowered by the sheet and a fixing defect is thus caused.

In the above illustrative embodiment, when the first detected temperature Ts1 detected at the early stage of the control is lower than the ready temperature TR, the control of the present disclosure of gradually increasing each of the target temperatures TP1, TP2 is executed. However, the present disclosure is not limited thereto. For example, the control of the present disclosure may be executed, irrespective of the detected temperature detected at the early stage of the control, or may be executed when the detected temperature detected at the early stage is equal to or lower than a temperature higher than the ready temperature.

The sheet S may be a sheet such as a thick sheet, a postcard, a thin sheet and the like or may be an OHP sheet and the like.

A developer image forming unit is arbitrarily configured as the process unit. For example, a developer image forming unit configured to expose the photosensitive drum by an LED head may also be used.

In the above illustrative embodiment, the heating roller has been exemplified as the heating member. However, the present disclosure is not limited thereto. For example, the heating member may be a plate-shaped nip member that is to be heated by a heat source, a fixing belt interposed between the nip member and the pressing member, or the like.

In the above illustrative embodiment, the halogen lamp has been exemplified as the heat source. However, the present disclosure is not limited thereto. For example, the heat source may be a solid heat-generating element such as a carbon heater.

In the above illustrative embodiment, the thermistor has been exemplified as the temperature detector. However, the present disclosure is not limited thereto. For example, any sensor configured to detect a temperature can be used.

In the above illustrative embodiment, when the printing command is received, both the first heat source H1 and the second heat source H2 are turned on. However, both the first heat source H1 and the second heat source H2 may be turned on when the sheet S is a wide width of a sheet to contact the first region 81A and the second regions 81B, 81C, and may be turned on, based on the printing command.

In the meantime, for example, when the sheet S is a narrow width of a sheet that is to contact the first region 81A but is barely to contact the second regions 81B, 81C, the controller 100 may execute only the first supplying processing to turn on only the first heat source H1 and to set the fixing temperatures of the second regions 81B, 81C to be low.

In the above illustrative embodiment, the two heat sources of the first heat source H1 and the second heat source H2 are provided. However, the present disclosure is not limited thereto. For example, it may also be possible to increase a target temperature with a predetermined gradient for a single heat source. Also, three or more heat sources may be provided and it may be possible to increase a target temperature with a predetermined gradient for each heat source.

In the above illustrative embodiment, the first temperature detector ST1 is configured to be in contactless with the heating member 81. However, the present disclosure is not limited thereto. For example, the first temperature detector may be configured to be in contact with the heating member. Also, the second temperature detector may be configured to be in contactless with the heating member.

In the above illustrative embodiment, the present disclosure has been applied to the laser printer 1. However, the present disclosure is not limited thereto. For example, the present disclosure can be applied to the other image forming apparatus, for example, a copier, a complex machine and the like.

Also, the respective elements of the illustrative embodiment and modified embodiments can be implemented with being arbitrarily combined.

What is claimed is:

1. An image forming apparatus comprising:

a process unit configured to form a developer image on a sheet;

a heating member configured to heat a sheet;

a pressing member configured to press a sheet between the heating member and the pressing member;

a first heat source configured to heat the heating member;

a second heat source configured to heat the heating member;

a first temperature detector configured to detect a temperature of a first region including a central portion of the heating member in a width direction;

a second temperature detector configured to detect a temperature of a second region closer to an end portion than the first region of the heating member; and a controller configured to execute:

first supplying processing of supplying a current to the first heat source based on a detection result of the first temperature detector such that the temperature of the first region reaches a first target temperature, and of increasing the first target temperature with a first gradient toward a first fixing temperature at which a developer image is fixed on a sheet; and second supplying processing of supplying a current to the second heat source based on a detection result of the second temperature detector such that the temperature of the second region reaches a second target temperature, and of increasing the second target temperature with a second gradient toward a second fixing temperature at which a developer image is fixed on a sheet, wherein in the first region, an output of the first heat source is larger than an output of the second heat source, and in the second region, an output of the second heat source is larger than an output of the first heat source.

2. The image forming apparatus according to claim 1, wherein the first gradient and the second gradient are different from each other.

3. The image forming apparatus according to claim 2, wherein the second fixing temperature is lower than the first fixing temperature, and the second gradient is smaller than the first gradient.

4. The image forming apparatus according to claim 1, wherein in the first supplying processing, the controller is configured to change a current to the first heat source such that the smaller a first deviation between the temperature of the first region and the first target temperature is, the smaller the current to the first heat source is.

5. The image forming apparatus according to claim 1, wherein in the first supplying processing, the controller is configured to stepwise increase the first target temperature to increase the first target temperature with the first gradient.

6. The image forming apparatus according to claim 1, wherein in the second supplying processing, the controller is configured to change a current to the second heat source such that the smaller a second deviation between the temperature of the second region and the second target temperature is, the smaller the current to the second heat source is.

7. The image forming apparatus according to claim 1, wherein in the second supplying processing, the controller is configured to stepwise increase the second target temperature to increase the second target temperature with the second gradient.

8. The image forming apparatus according to claim 1, wherein in the first supplying processing, the controller is configured to set the first target temperature to a first initial temperature lower than the first fixing temperature when the controller starts supplying a current to the first heat source, and increase the first target temperature with the first gradient based on a condition that the temperature of the first region reaches a first switching temperature lower than the first initial temperature.

9. The image forming apparatus according to claim 1, wherein in the second supplying processing, the controller is configured to set the second target temperature to a second initial temperature lower than the second fixing temperature when the controller starts supplying a current to the second heat source, and increase the second target temperature with the second gradient based on a condition that the temperature of the second region reaches a second switching temperature lower than the second initial temperature.

10. A control method of an image forming apparatus comprising:

a process unit configured to form a developer image on a sheet;

a heating member configured to heat a sheet;

a pressing member configured to press a sheet between the heating member and the pressing member;

a first heat source configured to heat the heating member; and a second heat source configured to heat the heating member, wherein in a first region including a central portion of the heating member, an output of the first heat source is larger than an output of the second heat source, in a second region closer to an end portion than the first region of the heating member, an output of the second heat source is larger than an output of the first heat source, and the control method comprising:

a first supplying processing step of supplying a current to the first heat source based on a temperature of the first region such that the temperature of the first region reaches a first target temperature, and of increasing the first target temperature with a first gradient toward a first fixing temperature at which a developer image is fixed on a sheet; and a second supplying processing step of supplying a current to the second heat source based on a temperature of the second region such that the temperature of the second region reaches a second target temperature, and of increasing the second target temperature with a second gradient toward a second fixing temperature at which a developer image is fixed on a sheet.

11. The control method according to claim 10, wherein the first gradient and the second gradient are different from each other.

12. The control method according to claim 11, wherein the second fixing temperature is lower than the first fixing temperature, and the second gradient is smaller than the first gradient.

13. The control method according to claim 10, wherein in the first supplying processing step, a current to the first heat source is changed such that the smaller a first deviation between the temperature of the first region and the first target temperature is, the smaller the current to the first heat source is.

14. The control method according to claim 10, wherein in the first supplying processing step, the first target temperature is stepwise increased to increase the first target temperature with the first gradient.

15. The control method according to claim 10, wherein in the second supplying processing step, a current to the second heat source is changed such that the smaller a second deviation between the temperature of the second region and the second target temperature is, the smaller the current to the second heat source is.

16. The control method according to claim 10, wherein in the second supplying processing step, the second target temperature is stepwise increased to increase the second target temperature with the second gradient.

17. The control method according to claim 10, wherein in the first supplying processing step, the first target temperature is set to a first initial temperature when the supply of the current to the first heat source starts, and the first target temperature is increased with the first gradient based on a condition that the temperature of the first region reaches a first switching temperature.

18. The control method according to claim 10, wherein in the second supplying processing step, the second target temperature is set to a second initial temperature when the supply of the current to the second heat source starts, and the second target temperature is increased with the second gradient based on a condition that the temperature of the second region reaches a second switching temperature.

19. An image forming apparatus comprising:

a process unit configured to form a developer image on a sheet;

a heating member configured to heat a sheet;

a pressing member configured to press a sheet between the heating member and the press member;

a first heat source having a first filament and configured to heat the heating member;

a second heat source having a second filament and configured to heat the heating member;

a first temperature detector configured to detect a temperature of a first region including a central portion of the heating member in a width direction;

a second temperature detector configured to detect a temperature of a second region closer to an end portion than the first region of the heating member; and a controller configured to execute:

first supplying processing of supplying a current to the first heat source based on a detection result of the first temperature detector such that the temperature of the first region reaches a first target temperature, and of increasing the first target temperature with a first gradient toward a first fixing temperature at which a developer image is fixed on a sheet; and second supplying processing of supplying a current to the second heat source based on a detection result of the second temperature detector such that the temperature of the second region reaches a second target temperature, and of increasing the second target temperature with a second gradient toward a second fixing temperature at which a developer image is fixed on a sheet, wherein in the first region, a density of the first filament is higher than a density of the second filament, and in the second region, a density of the second filament is higher than a density of the first filament.

20. An image forming apparatus comprising:

a photosensitive drum;

a heating roller for heating a sheet;

a pressing roller for pressing a sheet between the heating roller and the pressing roller;

a first halogen heater for heating the heating roller;

a second halogen heater for heating the heating roller;

a first sensor for detecting a temperature of a first region including a central portion of the heating roller;

a second sensor for detecting a temperature of a second region closer to an end portion than the first region of the heating roller;

a controller configured to execute:

first supplying processing of supplying a current to the first halogen heater based on a detection result of the first sensor such that the temperature of the first region reaches a first target temperature, and of increasing the first target temperature with a first gradient toward a first fixing temperature at which a developer image is fixed on a sheet; and second supplying processing of supplying a current to the second halogen heater based on a detection result of the second sensor such that the temperature of the second region reaches a second target temperature, and of increasing the second target temperature with a second gradient toward a second fixing temperature at which a developer image is fixed on a sheet, wherein in the first region, an output of the first halogen heater is larger than an output of the second halogen heater, and in the second region, an output of the second heat source is larger than an output of the first halogen heater.

* * * * *